United States Patent [19]

Yoshimoto et al.

[11] 4,288,261

[45] Sep. 8, 1981

[54] METHOD FOR THE HEAT TREATMENT OF ALUMINUM STRIP

[76] Inventors: Hiromu Yoshimoto, 1-18 Aza Tabuchi, Yawata, Chita-shi; Michitoshi Okumura, 139 3-chome, Jojo-cho, Kasugai-shi; Kenji Kawate, 4-2 Naruko-cho, Midori-ku, Nagoya-shi, all of Aichi-ken, Japan

[21] Appl. No.: 57,474

[22] Filed: Jul. 13, 1979

[30] Foreign Application Priority Data

Jul. 15, 1978 [JP] Japan ..... 53-86559

[51] Int. Cl.[3] ..... C22F 1/04

[52] U.S. Cl. ..... 148/131

[58] Field of Search ..... 148/13, 131

[56] References Cited

U.S. PATENT DOCUMENTS 3,148,093 9/1964 Williams et al. ..... 148/131

3,262,822 7/1966 Griffith ..... 148/13

*Primary Examiner*—R. Dean

*Attorney, Agent, or Firm*—William A. Drucker

[57] ABSTRACT

During the process in which an aluminum strip is moved in a floating mode, the strip is first heated, then cooled and annealed. When the aluminum strip is cooled, the strip is moved while being curved into a wave-like form toward the moving direction thereof. The aluminum strip is curved in a manner as described, and as a result, the aluminum strip increases in antibuckling stress. The increased antibuckling stress overcomes a thermal stress produced in the direction of the width of the aluminum strip during the process of cooling. Accordingly, the aluminum strip is cooled without formation of wrinkle parallel to the longitudinal direction of the strip.

4 Claims, 12 Drawing Figures

METHOD FOR THE HEAT TREATMENT OF ALUMINUM STRIP

BACKGROUND OF THE INVENTION

1. Field of the Invention

The present invention relates to a method for the heat treatment of aluminum strip, the method comprising heating an aluminum strip while being passed through a heating zone, and then cooling the strip while being passed through a cooling zone, thereby applying heat treatment such as annealing to the aluminum strip.

2. Description of the Prior Art

In prior arts, in the case where an aluminum strip (The term "aluminum strip" as used herein indicates a thin and lengthy band-like aluminum plate continuously rolled by a rolling mill. The thickness of the aluminum plate is normally less than 3.5 mm, and the plate has various widths.) is subject to heat treatment as mentioned above, the strip in a floating condition is permitted to pass through a heating zone and a cooling zone for heat treatment. In this case, antibuckling stress in the direction of the width of aluminum strip is small, and hence, for example, when great widthwise thermal stress produced in the strip passes through a boundary region between the heating zone and the cooling zone overcomes the antibuckling stress, there are sometimes produced wrinkles, in the aluminum strip, parallel to the moving direction 30 thereof, in other words, longitudinal wrinkles 41, as shown in FIG. 12, resulting in a defective aluminum strip.

SUMMARY OF THE INVENTION

It is therefore an object of the present invention to provide a heat treating method which can heat-treat an aluminum strip while the latter is permitted to pass through a heating zone and a cooling zone in a floating condition to thereby heat-treat the strip without a scratch on the surface thereof and to obtain products of good quality.

It is a further object of the present invention to provide a heat treating method which can heat-treat even an aluminum strip, which is liable to produce a longitudinal wrinkle because of a thin material, without substantially producing the longitudinal wrinkle, thus providing products of good quality.

That is, in accordance with the present invention, where an aluminum strip is permitted to pass through a position in the close vicinity of an inlet within the cooling zone, the aluminum strip is curved or bent in the form of a wave. In this case, the radius of curvature of said curved portion is made smaller than the value represented by $$R = \sqrt{\frac{x \times 0.339}{y^3}}$$

(where, x is the sum of the length of the heating zone and the length of the cooling zone, and y is the width of the aluminum strip.) Thus, the antibuckling stress of the aluminum strip becomes greater than the thermal stress produced in the aluminum strip. Accordingly, even if the aluminum strip is heat-treated, no longitudinal wrinkle that may materially diminish the value in goods of aluminum strip is produced in the aluminum strip.

BRIEF DESCRIPTION OF THE DRAWINGS

(In FIGS. 1 through 3, corresponding parts therebetween are all shown aligned in position.)

DESCRIPTION OF THE PREFERRED EMBODIMENTS

Figure 1:
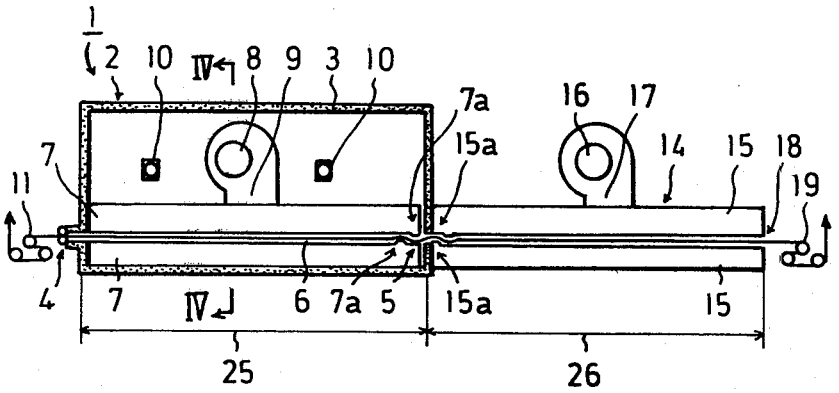
FIG. 1 is a schematic longitudinal sectional view of a heat treating apparatus.
Figure 4:
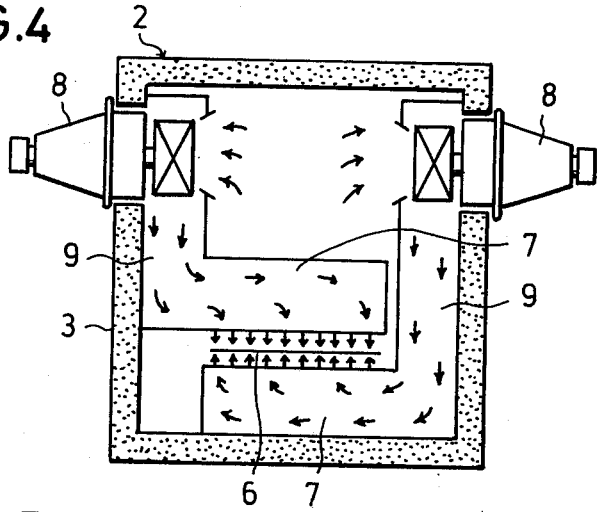
FIG. 4 is an enlarged sectional view taken on line IV—IV of FIG. 1.

Referring now to FIG. 1, there is shown a heat treatment apparatus 1 which comprises a heating apparatus 2 and a cooling apparatus 14. First, the heating apparatus 2 will be described. This heating apparatus 2 is shown in longitudinal section in FIG. 4.

A furnace wall 3 is designed to form a heat shielding between the interior and exterior thereof in a known manner. The furnace wall 3 is provided with an entrance port 4 and a reception port 5. An aluminum strip 6 is inserted through the entrance port 4 and reception port 5 as shown. Plenum chambers 7, 7 are provided in a space interiorly of the furnace wall 3. These plenum chambers 7, 7 are located opposedly in a position through which aluminum strip 6 passes. On the surfaces opposed to each other in the plenum chambers 7, 7 there are disposed a plurality of gas blowing nozzles in a known manner. Further, at the ends of the surfaces opposed to each other in the plenum chambers 7, 7 there are provided sections of the wavy motion 7*a* and 7*a*, which will be later described in detail. The furnace wall 3 has a circulation fan 8 mounted thereon. A conduit 9 has one end communicated with the circulation fan 8, and the other end communicated with the plenum chamber 7. Further, a burner 10 is disposed internally of the furnace wall 3. Frontwardly of the entrance port 4 there is disposed a guide roll 11 for guiding the aluminum strip 6 towards the entrance port 4 in a stabilized fashion.

Next, the cooling apparatus 14 will be described. The cooling apparatus 14 is composed of plenum chambers 15, 15, provided with a section of the wavy motion 15*a*, a blower 16, a conduit 17, and the like, similarly to the abovementioned heating apparatus 2 with the exception of provision of the furnace wall for the heat shielding, burner, and the like, as in the heating apparatus 2. A discharge port 18 for the strip 6 is provided between the plenum chambers 15, 15. Rearwardly of the discharge port 18, there is provided a let off roll 19 for delivering the aluminum strip 6 in a stabilized fashion.

Figure 5:
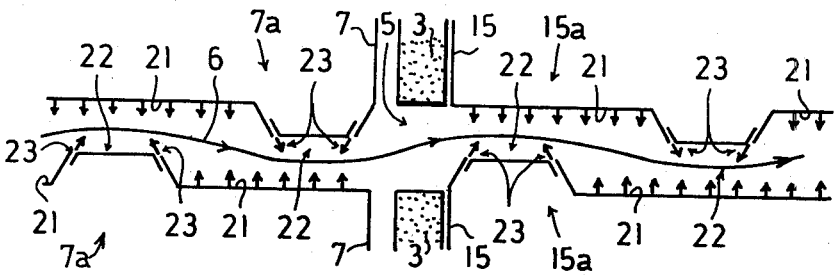
FIGS. 5 through 7 are enlarged illustrations of essential portions in FIGS. 1 through 3, respectively.

Details of wavy motion sections 7*a*, 15*a* in the plenum chambers 7, 15, respectively, will be explained with reference to FIG. 5. First, the section of wavy motion 7*a* in the plenum chamber 7 has nozzle plate members 21 and static pressure pads 22 opposed to the aluminum strip 6 to be inserted. The width of these nozzle plate members 21 and static pressure pads 22, namely, the length perpendicular to the paper surface in FIG. 5, is the same as or greater than the width W (see FIG. 9) of the aluminum strip 6. The nozzle plate member 21 has a plurality of nozzles disposed thereon so as to jet gases within the chamber 7 toward the aluminum strip 6. Similar to well-known static pressure pads, the static pressure pad 22 has ports 23, 23 of the length which is the same as or greater than the width of the aluminum strip 6, so that the gases within the plenum chamber 7 are jetted from the ports 23, 23 toward the aluminum strip 6.

The wavy motion section 15*a* in the plenum chamber 15 has also nozzle plate members and static pressure pads similar to the wavy motion section 7*a* in the plenum chamber 7 as previously described. So far as function is concerned, the structure of these nozzle plate members and static pressure pads is similar to that of those in the above-mentioned plenum chamber 7, and therefore, like parts bear like reference numerals used in the above-mentioned plenum chamber 7 so that double description will not be made.

Figure 9:
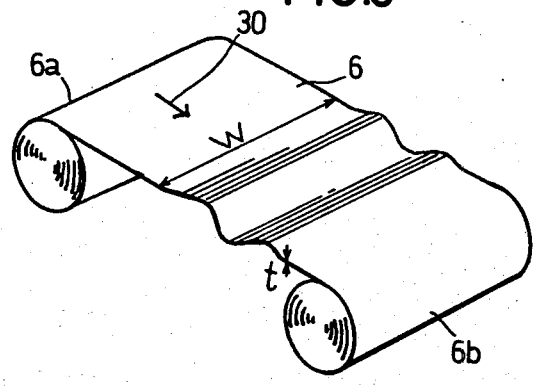
FIG. 9 is a schematic perspective view showing a state wherein the aluminum strip is paid off and rewound.

In the following, the operation will be explained. An aluminum strip 6*a* wound around a pay off reel as shown in FIG. 9 is paid off as indicated by the arrow 30 in a known manner. The thus paid off aluminum strip 6 passes through various known devices, after which it is inserted through the heat treatment apparatus 1. The aluminum strip 6 issued from the heat treatment apparatus 1 passes through various known devices, after which it is wound around the rewind reel as shown at 6*b*.

In a state where the aluminum strip 6 is inserted through the heat treatment apparatus as previously mentioned, the burner 10, fans 8 and 16 are driven. In the steady condition, the aluminum strip 6 is held floated between the plenum chambers 7, 7, and between the plenum chambers 15, 15 by the hot gases (in the chamber 15, normal air not heated) blown through the nozzles in these chambers. In a portion wherein the aluminum strip 6 is opposed to the wavy motion sections 7*a*, 15*a* of the chambers 7, 15, respectively, the strip is curved in the form of a wave toward the moving direction thereof as shown in FIG. 5 in detail. It is noted the fans, chambers and the like in the heating apparatus 2 and cooling apparatus 14 are designed so as to provide functions as described above and to provide characteristics of increasing and decreasing temperatures of aluminum strip 6 as will be described later.

The aluminum strip 6 passing through the heat treatment apparatus 1 in a floating mode is heated by the heating apparatus 2 and then cooled by the cooling apparatus 14.

In FIG. 1, a heating zone and a cooling zone are indicated at 25 and 26, respectively.

Figure 2:
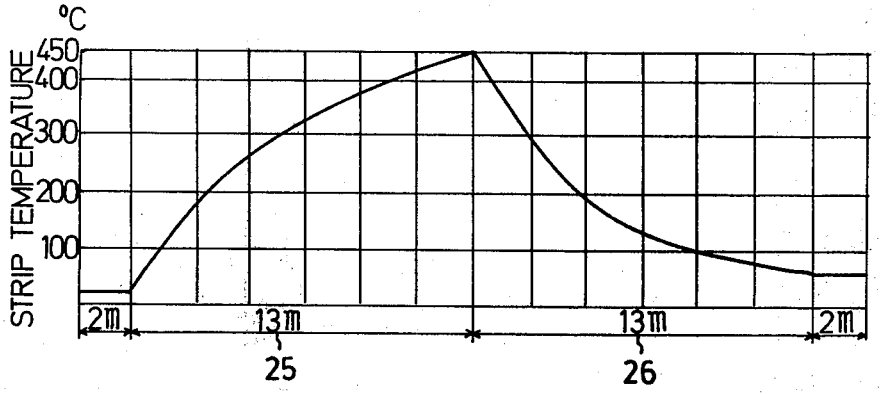
FIG. 2 is a graphic representation showing changes in temperature of the aluminum strip.
Figure 6:
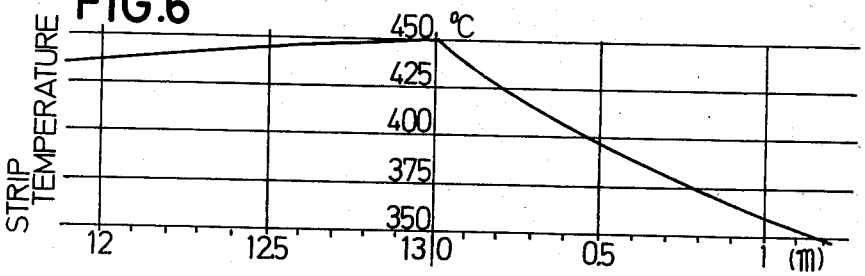
Figure 8:
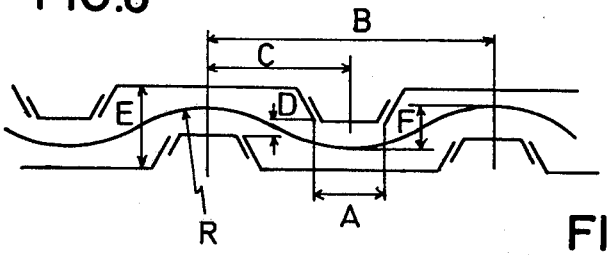
FIG. 8 is a sectional view of assistance in explaining the dimensions of a section of the wave motion.

The temperature of the aluminum strip 6 subjected to heat treatment as described above changes as shown in FIG. 2 by way of one example. (The state of change in temperatures in the vicinity of the boundary between the heating zone 25 and the cooling zone 26 is shown in detail in FIG. 6.) Dimensions of various members are indicated hereinafter. The dimension of the aluminum strip is 0.3t×2000 W; the length from the guide roll 11 to the entrance port 4 is 2 m; the length of the heating zone 25 and cooling zone 26 is 13 m; and the length from the discharge port 18 to the left off roll 19 is 2 m. Dimensions of various portions in the wavy motion sections 7*a* and 15*a* are indicated in connection with FIG. 8 as follows: A=250 mm, B=1,200 mm, C=600 mm, D=50 mm, E=200 mm, F=approximately 90 mm, and radius of curvature R of the aluminum strip 6 is 1.05 m.

Figure 3:
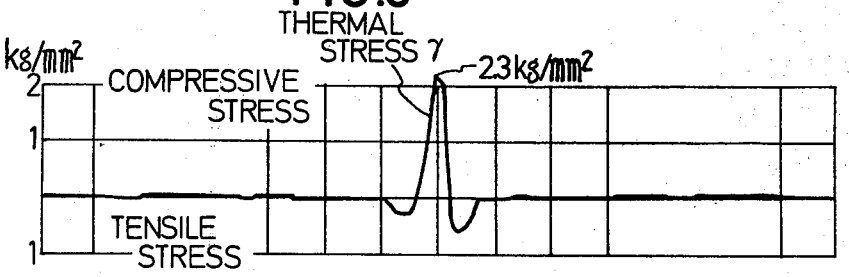
FIG. 3 is a graphic representation showing a state wherein a thermal stress is produced in the aluminum strip.
Figure 7:
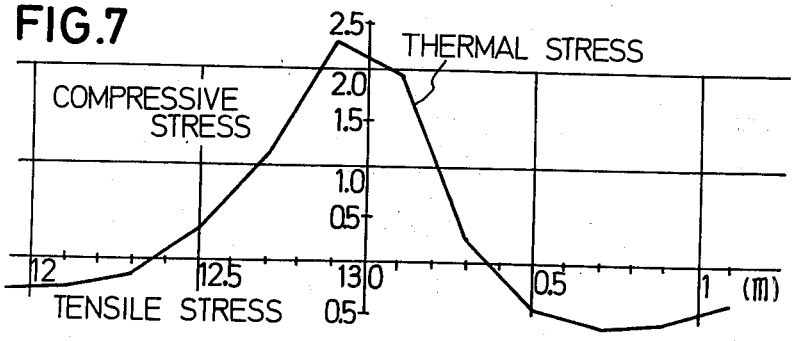

During the process wherein the aluminum strip 6 is heated and cooled, the thermal stress $\gamma$ (the termal stress in the width of the strip) is produced in the center in the width of the aluminum strip 6 so as to have a large value as shown in FIG. 3, that is, in the vicinity of the boundary between the heating zone 25 and the cooling zone 26. (For details, see FIG. 7.) However, the aluminum strip 6 is curved in such a region as previously mentioned by the wavy motion sections 7*a* and 15*a*, and hence, the widthwise antibuckling stress of the strip is greater than such thermal stress so that the strip keeps its original shape without being deformed by the thermal stress.

Figure 10:
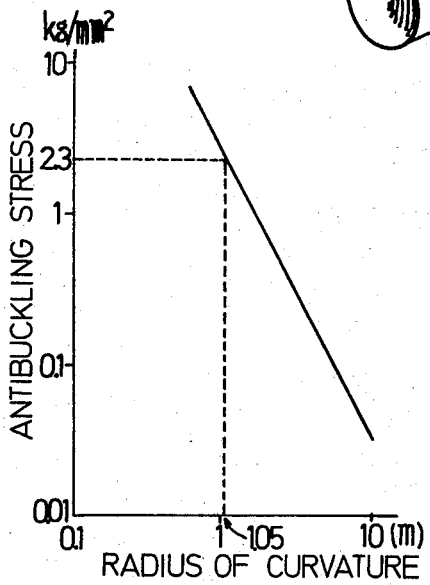
FIG. 10 is a graphic representation showing the relationship between the radius of curvature and antibuckling stress of the aluminum strip.
Figure 12:
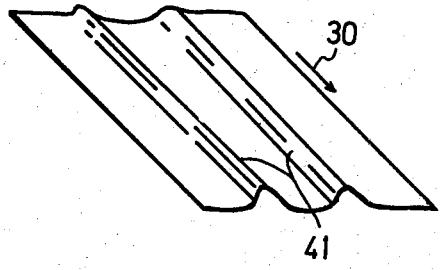
FIG. 12 is a perspective view showing a state wherein wrinkles are produced in prior arts.

FIG. 10 shows the relationship between the radius of curvature and antibuckling stress of the aluminum strip having the dimension as described above. In the case of the preceding example, the maximum thermal stress is 2.3 kg/mm$^2$ as shown in FIG. 3. Accordingly, the maximum radius of curvature of 1.05 m from which antibuckling stress capable of withstanding the aforesaid maximum thermal stress is obtained may be found from the graph shown in FIG. 10. It will be noted that in the case the magnitude of thermal stress varies with the type of material or the like, the radius of curvature capable of obtaining the antibuckling stress in correspondence thereto may be found. And various dimensions of the wavy motion sections 7*a* and 15*a* or jetting pressures of gases issued from the nozzles are selected so that the aluminum strip 6 may be curved into the radius of curvature thus obtained.

It has been found that the thermal stress as noted above increases nearly in proportion to the width of the strip 6 and decreases nearly in proportion to the full length of furnace (the sum of the length of the heating zone 25 and the length of the cooling zone 26). It has also been found that the antibuckling stress when the strip 6 is curved is in inverse proportion to a square of the radius of curvature and in inverse to a square of the strip width. Accordingly, it has been found from the foregoing points and various test results that the antibuckling stress capable of withstanding thermal stress produced in the strip may be obtained by setting the radius of curvature R of the aluminum strip 6 to a value smaller than that obtained by $$R = \sqrt{\frac{x \times 0.339}{y^3}}$$

where, x is the sum of the length of the heating zone 25 and the length of the cooling zone 26, and y is the width of aluminum strip.

It is preferable that a position at which wavy motion is applied to the aluminum strip 6 in the aforementioned wavy motion section corresponds to a position at which a great thermal stress is produced in the aluminum strip 6. For example, where the position at which a great thermal stress is produced, in FIG. 3, is in the inner part of the cooling zone, the position at which the strip is curved is also desirable in the inner part of the cooling zone accordingly.

Figure 11:
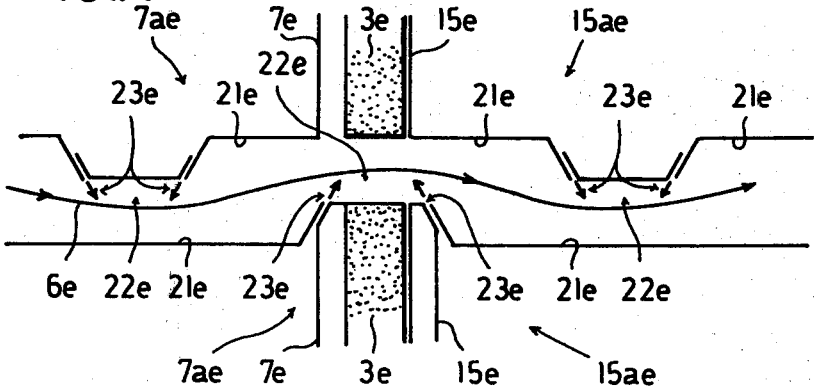
FIG. 11 is a view similar to FIG. 5 showing a different form of embodiment.

Next, FIG. 11 shows a further embodiment of the present invention, in which static pressure pads 22*e* in wavy motion sections *7ae*, 15*ae* of plenum chambers *7e*, 15*e*, respectively, are differently positioned.

Since the static pressure pads 22*e* are positioned as just mentioned, an aluminum strip 6*e* may be moved curved as shown to obtain a great antibuckling stress similar to the preceding embodiment.

It is noted that parts shown in FIG. 11 considered identical or equal in structure to those shown in FIG. 5 in function bear like reference numerals in FIG. 5 with an index "e" affixed thereto, and double explanation will not be made.

It should be noted that the radius of curvature determined in the case the aluminum strip is curved during the process of moving the aluminum strip as described above may be set to a value smaller than the value R as previously mentioned. In the case of the radius of curvature set to a small value as just mentioned, even if wrinkles are produced in the strip due to thermal stress produced therein during the process of moving the aluminum strip, the strip remains curved so as to have such a small radius of curvature, and as a consequence, it is possible to smooth the thus produced wrinkles to the extent that the wrinkles disappear.

While, in the embodiments so far described, the plenum chambers have been used in the heating apparatus and cooling apparatus, it should be understood that in place of these plenum chambers, other suitable structures may also be employed in order to float the aluminum strip and to apply thereto heat treatment such as heating or cooling.

What is claimed is:

1. A method, for the heat treatment of aluminium strip, comprising the steps of:

(i) passing an aluminium strip in floating mode through a heating zone;

(ii) passing the strip, from the heating zone, through a cooling zone in a floating mode so as to be cooled thereby;

(iii) in a portion of the length of the moving strip passing from within the heating zone to within the cooling zone, imparting to the strip a wave-like form extending longitudinally of the strip and having a radius of curvature smaller than the value of the expression $$\sqrt{\frac{x \cdot 0.339}{y^3}}$$

wherein x is the sum of the lengths of the heating zone and of the cooling zone, and y is the width of the aluminium strip.

2. A method, as claimed in claim 1, wherein the strip is floated in the heating zone and in the cooling zone by jetting gas against upper and lower faces of the strip.

3. A method, as claimed in claim 2, wherein said wave-like form is imparted to the strip by applying, to the upper and lower faces of the strip, strong and weak jet of gas alternated along the longitudinal direction of the strip, the strong jets of each face being positioned opposite the weak jets of the other face.

4. A method, as claimed in claim 3, wherein the application of a weak jet of gas to the strip comprises applying plural jets spaced longitudinally of the strip and emerging from a plate disposed parallel to the strip, and wherein the application of a strong jet of gas comprises jetting gas from a static pressure pad inflated towards said plate member.

* * * * *